US010330354B2

(12) United States Patent
Kwon

(10) Patent No.: US 10,330,354 B2
(45) Date of Patent: Jun. 25, 2019

(54) HEAT DISSIPATING BLOWER AND REFRIGERATOR INCLUDING THE SAME

(71) Applicant: Dongbu Daewoo Electronics Corporation, Seoul (KR)

(72) Inventor: Hyuk Jang Kwon, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 15/482,476

(22) Filed: Apr. 7, 2017

(65) Prior Publication Data

US 2017/0314827 A1 Nov. 2, 2017

(30) Foreign Application Priority Data

May 2, 2016 (KR) ..... 10-2016-0053844

(51) Int. Cl.

| | |
|---|---|
| ***F25B 9/14*** | (2006.01) |
| ***F25B 25/00*** | (2006.01) |
| ***F25B 29/00*** | (2006.01) |
| ***F25B 39/04*** | (2006.01) |
| ***F25D 11/00*** | (2006.01) |
| ***F25D 23/00*** | (2006.01) |

(52) U.S. Cl.

CPC ..... *F25B 29/00* (2013.01); *F25B 9/14* (2013.01); *F25B 25/005* (2013.01); *F25B 39/04* (2013.01); *F25D 11/00* (2013.01); *F25D 23/003* (2013.01)

(58) Field of Classification Search

CPC ..... F25B 29/00; F25D 11/00; F25D 23/003
USPC ..... 415/220
See application file for complete search history.

(56) References Cited

U.S. PATENT DOCUMENTS

| | | | | |
|---|---|---|---|---|
| 4,353,680 | A * | 10/1982 | Hiraoka | F04D 29/646 415/201 |
| 4,505,641 | A * | 3/1985 | Tsuchikawa | F04D 29/326 415/173.6 |
| 4,566,852 | A * | 1/1986 | Hauser | B01D 53/005 123/41.49 |
| 5,117,523 | A * | 6/1992 | Jacobus | F25D 23/006 62/259.1 |
| 5,443,363 | A * | 8/1995 | Cho | F04D 29/164 415/211.1 |
| 5,489,186 | A * | 2/1996 | Yapp | F01D 5/141 415/208.3 |
| 7,317,267 | B2 * | 1/2008 | Schmid | F04D 29/601 248/603 |
| 8,337,155 | B2 * | 12/2012 | Yoo | F04D 29/668 361/679.48 |

(Continued)

FOREIGN PATENT DOCUMENTS

| | | |
|---|---|---|
| CN | 104295511 A | 1/2015 |
| JP | 2014-48036 | 3/2014 |
| KR | 10-2009-0069027 | 6/2009 |

*Primary Examiner* — Kun Kai Ma

(57) ABSTRACT

A heat dissipating blower for cooling a condenser in a refrigerator with reduced vibration and reduced noise. The heat dissipating blower includes a drive device configured to generate a rotational force, a fan coupled to the drive device, a support member configured to support the drive device, and a support frame coupled to the support member. The support member includes a fastening portion coupled to the drive device, and a connection frame spaced apart from the support frame. The heat dissipating blower further includes one or more vibration-attenuation members disposed between the connection frame and the support frame.

10 Claims, 5 Drawing Sheets

(56) References Cited

U.S. PATENT DOCUMENTS 8,619,423 B2 * 12/2013 Kim ..... B04C 3/00 361/694
9,180,772 B2 * 11/2015 Durello ..... B60K 11/02
2004/0191061 A1 * 9/2004 Jung ..... F04D 29/164 415/220
2006/0010901 A1 * 1/2006 Iwata ..... F24F 1/0007 62/426
2006/0147304 A1 * 7/2006 Cho ..... F04D 29/544 415/191
2006/0216147 A1 * 9/2006 Park ..... F04D 29/164 415/220
2007/0048138 A1 * 3/2007 Horski ..... F04D 29/526 416/179
2007/0248461 A1 * 10/2007 Lee ..... F04D 17/06 415/220
2008/0087025 A1 * 4/2008 McCain ..... F04D 29/526 62/3.7
2008/0279681 A1 * 11/2008 Eguchi ..... F04D 29/162 415/206
2009/0162203 A1 * 6/2009 Yoo ..... F04D 25/08 416/179
2009/0211287 A1 * 8/2009 Steele ..... B60H 1/3229 62/259.1
2010/0232971 A1 * 9/2010 Chen ..... F04D 29/384 416/223 R
2010/0300128 A1 * 12/2010 Chen ..... F24F 7/025 62/125
2016/0116204 A1 * 4/2016 Li ..... F04D 19/002 62/428
2016/0146224 A1 * 5/2016 Mutlu Bozay ..... F04D 29/668 62/296
2016/0177970 A1 * 6/2016 Watanabe ..... F04D 29/703 415/173.1

* cited by examiner

HEAT DISSIPATING BLOWER AND REFRIGERATOR INCLUDING THE SAME

CROSS-REFERENCE TO RELATED APPLICATIONS

This application is based on and claims priority from Korean Patent Application No. 10-2016-0053844, filed on May 2, 2016, the disclosure of which is incorporated herein in its entirety by reference for all purposes.

TECHNICAL FIELD

Embodiments of the present disclosure relate to refrigerators, and more particularly, to heat dissipation mechanisms in refrigerators.

BACKGROUND

A refrigerator is an appliance used for storing food or other times at low temperature, e.g., in a frozen state or refrigerated. Typically the storage space in the refrigerator is divided into a refrigeration compartment and a freezer.

The interior of the refrigerator is cooled by cold air circulating therein. Cold air can be continuously generated by a heat exchanger as a refrigerant flows therein and recycles through compression, condensation, expansion and evaporation. Cold air supplied in the refrigerator is uniformly distributed by convection.

The heat exchanger can be installed at one side of the refrigerator separate from the storage spaces such as the refrigeration compartment and the freezer for storing food. For example, compression and condensation processes may be performed by a compressor and a condenser disposed within a machine room formed at the lower side of a rear surface of the refrigerator. The refrigerant in the evaporator can absorb heat from ambient air and thereby cool the ambient air into cold air.

A heat dissipating blower including a fan is typically used to air cool the condenser. Unfortunately, a conventionally heat dissipating blower usually causes excessive vibration and noise during operation.

SUMMARY

Embodiments of the present disclosure provide a heat dissipating blower in a refrigerator that can operate with reduce vibration and noise.

According to embodiments of the present disclosure, a heat dissipating blower includes structural improvements for reducing operational vibration and noise.

According to an embodiment of the present invention, a heat dissipating blower includes a drive device configured to generate a rotational force; a fan coupled to the drive device; a support member configured to support the drive device; and a support frame to which the support member is coupled. The support member includes: a fastening portion coupled to the drive device; and a connection frame disposed in a spaced-apart relationship with the support frame.

Further, the connection frame may have an inner tapering surface formed in a convex shape toward an inner side.

Further, the connection frame may have a groove opened toward one side in an axial direction.

Further, vibration-proof members may be disposed between the connection frame and the support frame.

Further, the support member may include bridges configured to interconnect the fastening portion and the connection frame.

Further, the bridges may include first bridge portions extending toward one side in an axial direction and second bridge portions coupled to the first bridge portions and configured to extend in a direction deviated from a radial direction by a predetermined angle.

DETAILED DESCRIPTION

Figure 1:
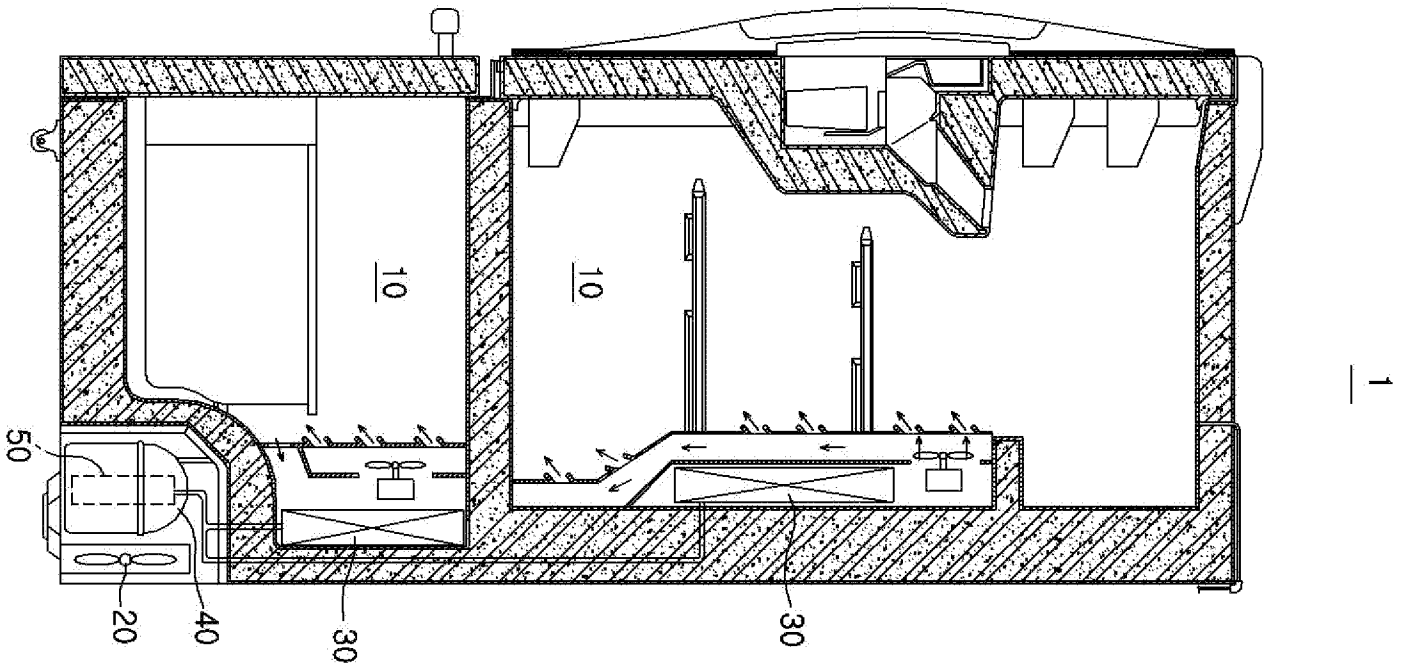
FIG. 1 is a perspective view illustrating a refrigerator disposed with an exemplary heat dissipating blower according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is merely exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form due to manufacturing.

The specific configuration of a heat dissipating blower according to one embodiment of the present disclosure will now be described with reference to FIGS. 1 to 5.

Figure 2:
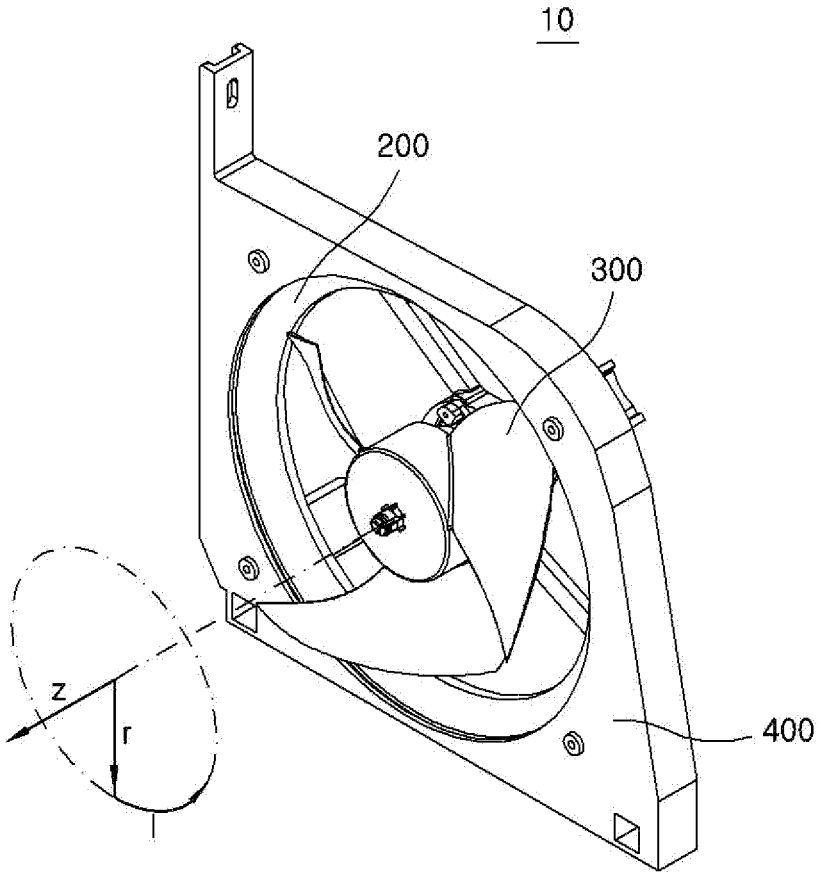
FIG. 2 is a perspective view of the exemplary heat dissipating blower illustrated in FIG. 1.
Figure 3:
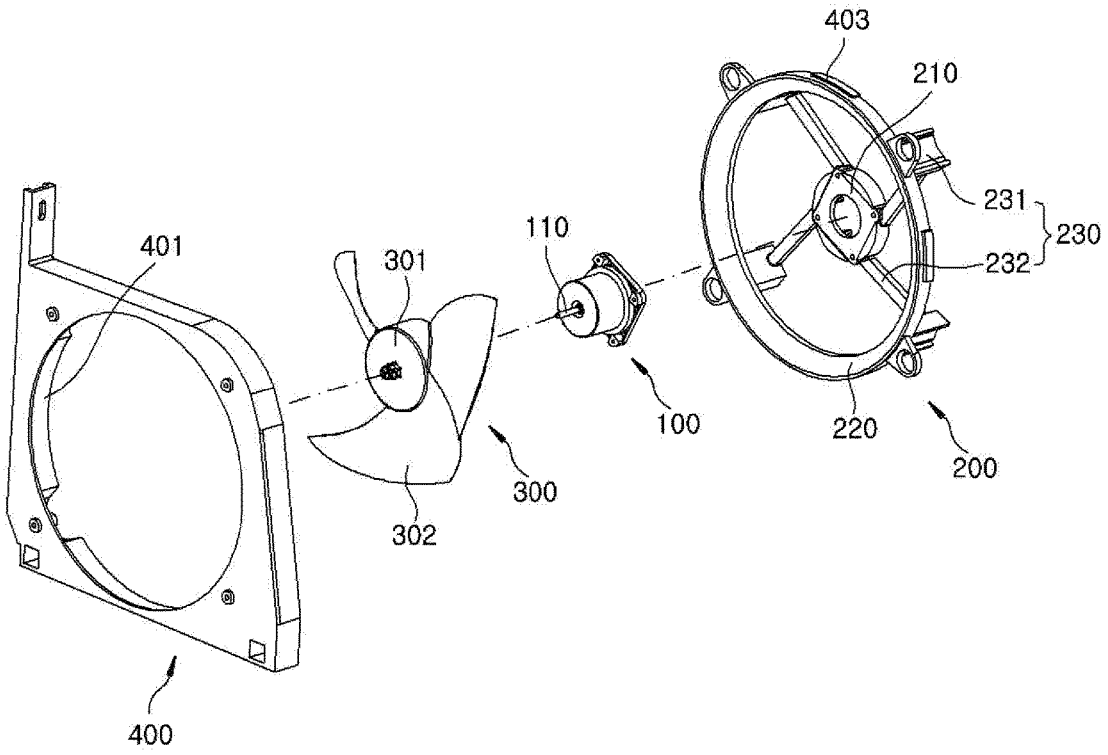
FIG. 3 is an exploded perspective view of the exemplary heat dissipating blower illustrated in FIG. 2.
Figure 4:
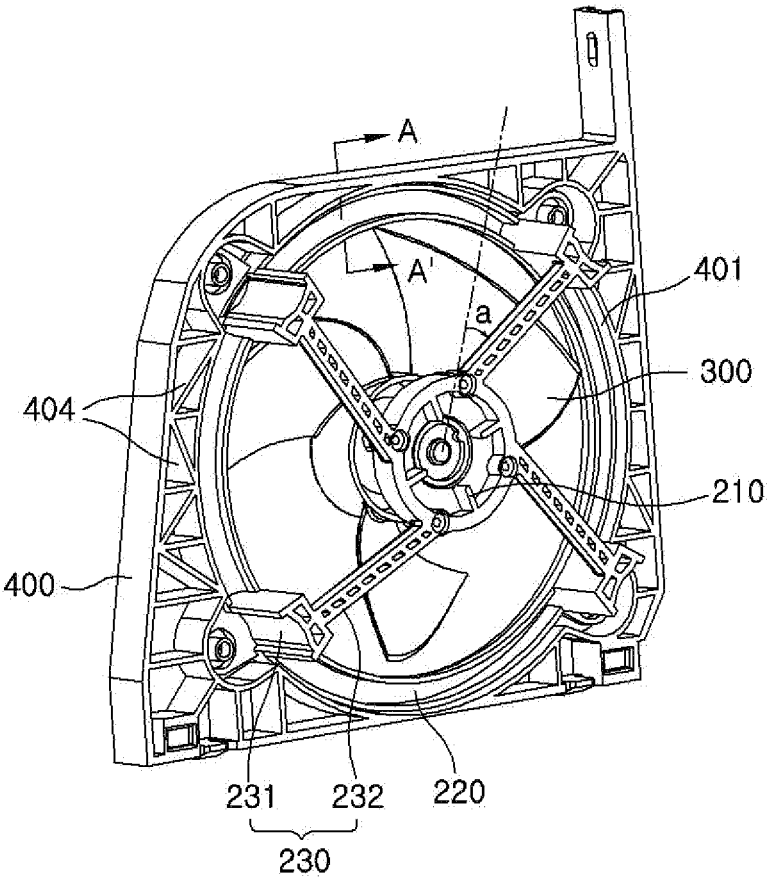
FIG. 4 is a rear perspective view of the exemplary heat dissipating blower illustrated in FIG. 2.
Figure 5:
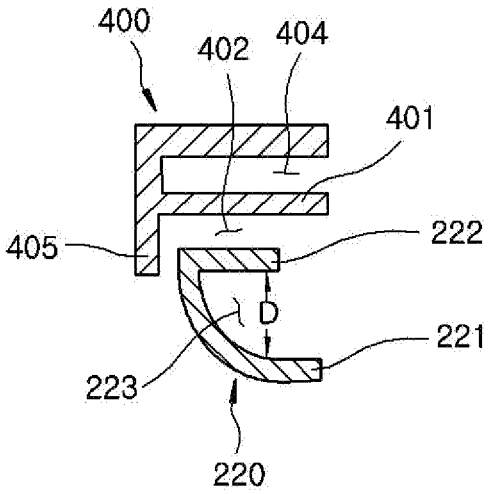
FIG. 5 is a sectional view taken along line A-A' in FIG. 4.

FIG. 1 is a perspective view illustrating a refrigerator disposed with an exemplary heat dissipating blower according to one embodiment of the present disclosure. FIG. 2 is a perspective view of the exemplary heat dissipating blower illustrated in FIG. 1. FIG. 3 is an exploded perspective view of the exemplary heat dissipating blower illustrated in FIG. 2. FIG. 4 is a rear perspective view of the exemplary heat dissipating blower illustrated in FIG. 2. FIG. 5 is a sectional view taken along line A-A' in FIG. 4.

Referring to FIGS. 1 to 5, the refrigerator 1 according to one embodiment of the present disclosure may include a heat dissipating blower 20. Furthermore, the refrigerator 1 is equipped with a cooling system including an evaporator 30, a compressor 40 and a condenser 50.

Hereinafter, an exemplary process of generating cold air by the cooling system is described. A gaseous refrigerant at high temperature exchanges heat with ambient air through the evaporator 30 and then flows to the compressor 40 to be compressed. The compressed gaseous refrigerant dissipates heat while it passes through the condenser 50 and becomes a liquid refrigerant. The liquid refrigerant passed through the condenser 50 flows back to the evaporator 30. The liquid refrigerant in the evaporator 30 is evaporated by absorbing heat from ambient air. Thus, in the evaporator 30, the liquid refrigerant receives heat from the ambient air and becomes a gaseous refrigerant. The gaseous refrigerant is separated from the liquid refrigerant and introduced into the compressor 40 again.

In the evaporator 30, the refrigerant absorbs heat from ambient air around the evaporator 30. As a result, cold air is generated and then supplied for circulation in the refrigerator storage rooms.

In this cold air generation process, the condenser 50 dissipates heat released from the refrigerant to the outside. The heat dissipating blower 20 assists the condenser 50 to dissipate condensation heat.

The heat dissipating blower 20 may include a drive device 100, a support member 200, a fan 300 and a support frame 400. Further, the heat dissipating blower may comprise a vibration-attenuation member disposed between the connection frame and the support frame.

The drive device 100 is configured to generate a rotational force for the fan 300. The drive device 100 may be, for example, an electric motor having a rotating shaft but is not necessarily limited this specific implementation. The drive device 100 can be coupled to the fan 300 through any suitable coupling mechanism that is well known in the art. For example, a rotating shaft 110 of the drive device 100 may be coupled to a fastening portion 210. As an alternative example, a rotor of the drive device 100 may be coupled to the fastening portion 210.

The support member 200 may include a fastening portion 210, bridges 230 and a connection frame 220. The fastening portion 210, the bridges 230 and the connection frame 220 may be integrally formed with each other. However, the present disclosure is not limited thereto.

The fastening portion 210 may support the drive device 100. The fastening portion 210 may be disposed between the drive device 100 and the fan 300. The fastening portion 210 may include a disc-shaped member but is not necessarily limited thereto.

The connection frame 220 may be a frame for connecting the bridges 230. The connection frame 220 may be disposed so as to surround the periphery of the fan 300 and may have a circular ring shape. A groove 223 may be formed in the connection frame 220. The groove 223 may be formed so that the groove 223 is opened toward one side in an axial direction. An inner surface 221 of the connection frame 220 may be formed in a tapering shape. An outer surface of the connection frame 220 may have a columnar shape such as a circular columnar shape or the like. The term "axial direction" used herein refers to a direction (Z direction) along which the rotating shaft 110 of the drive device 100 extends. The term "inner surface" used herein refers to a surface disposed at the inner side in the radial direction (r direction) of the rotating shaft 110 of the drive device 100. The term "outer surface" used herein refers to a surface disposed at the outer side in the radial direction (r direction) of the rotating shaft 110 of the drive device 100. Such a tapering surface may be formed in a convex shape toward the inner side in the radial direction. Viewed from the cross section of the connection frame 220, its inner surface 221 is bent inward and its outer surface 222 is flat.

Thus, the width D between the inner surface 221 and the outer surface 222 of the connection frame 220 may become increasingly smaller from one side (+Z side) toward the other side (−z side) in the axial direction. In addition, the inner surface 221 of the connection frame 220 may continuously extend along a circumferential direction 1. Further, the connection frame comprises a groove open toward one side in an axial direction.

The bridges 230 may interconnect the fastening portion 210 and the connection frame 220. Furthermore, the bridges 230 may support the drive device 100 and the fan 300 and the connection frame 220 surrounds the fan 300. The bridges 230 may include first bridge portions 231 and second bridge portions 232. The first bridge portions 231 may be coupled to one or more of the connection frame 220 and the support frame 400.

Furthermore, the first bridge portions 231 may extend toward one side in the axial direction. Also, the second bridge portions 232 may extend in a direction differing from the extension direction of the first bridge portions 231. For example, the second bridge portions 232 and the second bridge portions 232 may be disposed in a substantially perpendicular relationship with each other. The second bridge portions 232 may extend from the fastening portion 210 of the support member 200. The second bridge portions 232 may deviate by a predetermined angle "a" from the radial direction "r" in the circumferential direction "l".

The fan 300 can be rotated by the drive device 100. For example, the fan 300 may include a hub portion 301 coupled to the rotating shaft 110 of the drive device 100 and a plurality of blade portions 302.

The support frame 400 serves as a frame to which the support member 200 can be fixed. Furthermore, the support frame 400 may include a passage portion 401 which surrounds the connection frame 220 and has a shape conformal to the shape of the connection frame 220. For example, if the outer surface of the connection frame 220 is formed in a cylindrical shape, the passage portion 401 of the support frame 400 may be formed in a cylindrical shape. The support frame 400 may be spaced apart by a certain distance from the connection frame 220. In other words, a gap 402 may be formed between the support frame 400 and the connection frame 220.

Vibration-attenuation members 403 may be disposed in the gap 402 between the support frame 400 and the connection frame 220. The vibration-attenuation members 403 may be disposed in a plural number. The vibration-proof members 403 may be may be made of an elastic material such as rubber or the like but is not necessarily limited thereto.

Recesses 404 may be formed in the support frame 400. The recesses 404 may open toward one side in the axial direction. The recesses 404 of the support frame 400 and the groove 223 of the connection frame 220 may open toward the same side.

A protrusion portion 405 may be disposed in the passage portion 401 of the support frame 400. The protrusion portion 405 may protrude radially inward from the passage portion 401. The protrusion portion 405 may be disposed at the other side of the passage portion 401 in the axial direction. In other words, when viewed from the other side toward the one side in the axial direction, the protrusion portion 405 may cover the gap 402 and at least a portion of the connection frame 220.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but merely exemplary. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A heat dissipating blower comprising:

a drive device having a rotating shaft and configured to generate a rotational force;

a fan coupled to the drive device;

a support member configured to support the drive device; and a support frame coupled to the support member, wherein the support member comprises:

a fastening portion coupled to the drive device; and a connection frame disposed to surround a periphery of the fan, wherein an outer surface of the connection frame has a circular columnar shape, and a width between an inner surface of the connection frame and the outer surface of the connection frame is gradually decreasing from one side toward another side in an axial direction of the rotating shaft, wherein the support frame comprises:

a passage portion for surrounding the connection frame, the passage portion being spaced apart from the outer surface of the connection frame by a gap; and a protrusion portion disposed in the passage portion and protruded radially inward from the passage portion, wherein the protrusion portion is disposed at the another side of the passage portion in the axial direction of the rotating shaft such that the protrusion portion covers the gap and a portion of the connection frame when viewed from the another side toward the one side in the axial direction of the rotating shaft, wherein the connection frame further comprises a groove, and the support frame comprises recesses, wherein the groove and the recesses are opened toward the same side, and wherein the groove and the recesses are partially overlapped in a radial direction of the fan.

2. The heat dissipating blower of claim 1 further comprising a vibration-proof member disposed between the connection frame and the support frame.

3. The heat dissipating blower of claim 1, wherein the support member further comprises bridges configured to interconnect the fastening portion and the connection frame.

4. The heat dissipating blower of claim 3, wherein the bridges comprise first bridge portions extending toward the one side in the axial direction and second bridge portions coupled to the first bridge portions and configured to extend in a direction deviated from the radial direction by a predetermined angle.

5. A refrigerator comprising:

an evaporator configured to cool air by absorbing heat from the air through a refrigerant;

a compressor configured to compress the refrigerant supplied from the evaporator;

a condenser configured to dissipate heat while liquefying at least a part of the refrigerant compressed by the compressor, and a heat dissipating blower configured to cool the condenser, wherein the heat dissipating blower comprises:

a drive device having a rotating shaft and configured to generate a rotational force;

a fan coupled to the drive device;

a support member configured to support the drive device; and a support frame to which the support member is coupled, and wherein the support member comprises:

a fastening portion coupled to the drive device; and a connection frame disposed to surround a periphery of the fan, wherein an outer surface of the connection frame has a circular columnar shape, and a width between an inner surface of the connection frame and the outer surface of the connection frame is gradually decreasing from one side toward another side in an axial direction of the rotating shaft, wherein the support frame comprises:

a passage portion for surrounding the connection frame, the passage portion being spaced apart from the outer surface of the connection frame by a gap; and a protrusion portion disposed in the passage portion and protruded radially inward from the passage portion, wherein the protrusion portion is disposed at the another side of the passage portion in the axial direction of the rotating shaft such that the protrusion portion covers the gap and a portion of the connection frame when viewed from the another side toward the one side in the axial direction of the rotating shaft, wherein the connection frame further comprises a groove, and the support frame comprises recesses, wherein the groove and the recesses are opened toward the same side, and wherein the groove and the recesses are partially overlapped in a radial direction of the fan.

6. The refrigerator of claim 5, wherein the heat dissipating blower further comprises a vibration-attenuation member disposed between the connection frame and the support frame.

7. The refrigerator of claim 5, wherein the support member further comprises bridges configured to interconnect the fastening portion and the connection frame.

8. The refrigerator of claim 7, wherein the bridges comprise first bridge portions extending toward the one side in the axial direction.

9. The refrigerator of claim 8, wherein the support member further comprises second bridge portions coupled to the first bridge portions and configured to extend in a direction deviated from the radial direction by a predetermined angle.

10. The refrigerator of claim 6, wherein the vibration-attenuation member comprises an elastic material.

* * * * *